US011434588B2

(12) United States Patent
Mueller et al.

(10) Patent No.: US 11,434,588 B2
(45) Date of Patent: Sep. 6, 2022

(54) KNITTED SPACER FABRIC

(71) Applicant: NIKE, Inc., Beaverton, OR (US)

(72) Inventors: Juergen Mueller, Albstadt (DE); Oliver Buehler, Albstadt (DE); Bernd Boss, Albstadt (DE); Richa Maheshwari, Lowell, MA (US); Christopher J. Ranalli, Portland, OR (US); Heidi A. Vaughan, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/762,208

(22) PCT Filed: Nov. 2, 2018

(86) PCT No.: PCT/EP2018/079992
§ 371 (c)(1),
(2) Date: May 7, 2020

(87) PCT Pub. No.: WO2019/091864
PCT Pub. Date: May 16, 2019

(65) Prior Publication Data

US 2020/0354867 A1 Nov. 12, 2020

(30) Foreign Application Priority Data

Nov. 8, 2017 (DE) ..... 102017126047.1

(51) Int. Cl.
*D04B 1/22* (2006.01)
*D04B 1/12* (2006.01)

(52) U.S. Cl.
CPC ..... *D04B 1/22* (2013.01); *D04B 1/12* (2013.01); *D10B 2403/0221* (2013.01)

(58) Field of Classification Search
CPC ... D04B 1/12; D04B 1/22; D04B 1/10; D04B 1/102; D04B 7/16; D04B 7/24; D04B 9/12; D04B 9/26
See application file for complete search history.

(56) References Cited

U.S. PATENT DOCUMENTS 4,785,558 A * 11/1988 Shiomura ..... A43B 1/04 36/114
5,385,036 A * 1/1995 Spillane ..... A43B 1/04 2/16

(Continued)

FOREIGN PATENT DOCUMENTS

CN 105442163 A 3/2016
CN 205223530 U 5/2016

(Continued)

OTHER PUBLICATIONS

International Preliminary Report on Patentability dated May 12, 2020 in PCT/EP2018/079992.

(Continued)

*Primary Examiner* — Danny Worrell
(74) *Attorney, Agent, or Firm* — Shook, Hardy & Bacon L.L.P.

(57) ABSTRACT

A knitted spacer fabric has an upper knitted cover layer and a knitted lower cover layer, said cover layers being connected to one another by pile threads, wherein the cover layers are connected to one another by way of at least two different pile threads having dissimilar elasticity properties, and the cover layers are both knitted in a single-threaded or multiple-threaded manner across the entire area.

10 Claims, 1 Drawing Sheet

(56) References Cited

U.S. PATENT DOCUMENTS

| | | | | |
|---|---|---|---|---|
| 5,395,684 | A | 3/1995 | Robinson et al. | |
| 5,651,847 | A * | 7/1997 | Loeffler | D04B 1/16 66/19 |
| 5,896,758 | A * | 4/1999 | Rock | A43B 23/0205 66/191 |
| 6,105,401 | A * | 8/2000 | Chadeyron | D04B 1/22 66/195 |
| 6,196,032 | B1 * | 3/2001 | Rock | D04B 21/02 442/304 |
| 6,755,052 | B1 | 6/2004 | Sytz | |
| 7,565,821 | B2 | 7/2009 | Park et al. | |
| 7,849,715 | B2 * | 12/2010 | Starbuck | A41C 5/00 66/171 |
| 9,375,049 | B2 * | 6/2016 | Hazenberg | A43B 13/20 |
| 11,066,763 | B1 * | 7/2021 | Alexander | D04B 21/20 |
| 2004/0099016 | A1 | 5/2004 | Shepherd | |
| 2016/0263857 | A1 | 9/2016 | Mueller et al. | |

FOREIGN PATENT DOCUMENTS

| | | | |
|---|---|---|---|
| DE | 9302039 | U1 | 4/1993 |
| DE | 29917208 | U1 | 8/2000 |
| DE | 60219599 | T2 | 8/2007 |
| DE | 102015000501 | A1 | 8/2016 |
| WO | 9213125 | A1 | 8/1992 |
| WO | 02/064870 | A1 | 8/2002 |
| WO | 2009025556 | A1 | 2/2009 |
| WO | 2016169627 | A1 | 10/2016 |

OTHER PUBLICATIONS

International Search Report dated Mar. 6, 2019 issued in PCT/EP2018/079992.

German Search Report dated Jul. 31, 2018 issued in the corresponding German Patent Application 10 2017 126 047.1 (with English translation of relevant parts).

* cited by examiner

KNITTED SPACER FABRIC

CROSS REFERENCE TO RELATED APPLICATIONS

This application is the National Stage of PCT/EP2018/07992 filed on Nov. 2, 2018, which claims priority under 35 U.S.C. § 119 of German Application No. 10 2017 126 047.1 filed on Nov. 8, 2017, the disclosures of which are incorporated by reference. The international application under PCT article 21(2) was not published in English.

BACKGROUND OF THE INVENTION

Knitted spacer fabrics having a knitted upper cover layer and a knitted lower cover layer which are connected to one another by pile threads are double-faced knitted fabrics, the cover layers of the latter being held at a mutual spacing by way of the pile threads. On account thereof, said knitted fabrics are imparted cushioning properties. Moreover, said knitted fabrics are positively air-permeable and, in the case of a corresponding choice of the thread material used, can also regulate humidity and temperature such that various fields of application result in the clothing sector but also in technical fields.

The thickness of a knitted spacer fabric can be set by an adjustment of the mutual spacing of the needle beds of the knitting machine used in production. However, only knitted fabrics in which the mutual spacing of the cover layers is consistent across the entire area of the knitted fabric can be produced by way of this setting.

Therefore, a three-dimensional cloth in which the cover layers are connected in an alternating manner to one another by two different pile threads which, by virtue of the dissimilar elasticity properties thereof result in a dissimilar mutual spacing of the two cover layers has been proposed in DE 602 19 599 T2. Profiled effects in the knitted spacer fabric can be generated therewith. That pile thread that is currently not used as the spacer thread herein is conjointly knitted in one of the cover layers. On account thereof, however, this cover layer, as opposed to the opposite cover layer, is configured in a double-threaded manner and, on account thereof, is imparted both a greater thickness than the opposite cover layer as well as elasticity properties that are different from the opposite cover layer. The cross-section of the knitted spacer fabric is no longer symmetrical. The potential applications of this known knitted fabric are therefore limited. The two cover layers must have identical properties in most of the technical applications of knitted spacer fabrics. Moreover, the known knitted fabric becomes very heavy on one of the cover layers, on account of the pile thread being conjointly knitted.

The cover layers are also knitted in an at least double-threaded manner in the case of conventional knitted spacer fabrics having one pile thread as the spacer thread.

SUMMARY OF THE INVENTION

The invention is therefore based on the object of making available a three-dimensional profiled knitted spacer fabric, the potential application of said three-dimensional profiled knitted spacer fabric not being limited as opposed to the known knitted fabric.

This object is achieved by a knitted spacer fabric, in particular a knitted spacer fabric produced on a circular knitting machine, having a knitted upper cover layer and a knitted lower cover layer, said cover layers being connected to one another by pile threads, said knitted spacer fabric being characterized in that the cover layers are connected to one another by way of at least two different pile threads having dissimilar elasticity properties, and the pile threads are not conjointly knitted in the cover layers.

As opposed to the above-mentioned known knitted spacer fabric, both cover layers in the case of the knitted spacer fabric according to the invention are of identical thickness when threads of identical of comparable thickness are used in the production of said two cover layers. The pile threads that are used as spacer threads are tied into the cover layers only by tuck loops. The pile threads that are not used as spacer threads in a region are either guided so as to float between the cover layers or are partially tied into one of the cover layers. Therefore, the pile threads are not conjointly knitted with the cover layers at any location such that a thickening of one or both cover layers on account of the pile threads does not arise.

Only one of the pile threads can preferably in each case be used alternatingly for connecting the cover layers, such that the spacing between the cover layers is smaller in those regions in which the more elastic pile thread/threads are used than in those regions in which the less elastic pile thread/threads are used.

It is of course also possible for none of the pile threads to be used for connecting the cover layers in some regions. It is furthermore possible for the elasticity of one of the pile threads to be chosen to be high in such a manner that the cover layers bear on one another in those regions in which said pile thread is used. The three-dimensional character that is typical of knitted spacer fabrics is in this instance only present in those regions in which the pile thread, or the other pile threads, are used. Moreover, at least one of the pile threads can be a monofilament thread and be preferably composed of polyester. Such a monofilament thread is non-elastic and can be used in those regions in the knitted fabric in which a larger spacing between the cover layers is desired.

The cover layers can be preferably produced in a tricot construction or a twill construction. Said cover layers can moreover have a Jacquard pattern.

The pile threads in the regions where said pile threads are used can be connected to the cover layers by means of tuck loops. The pile threads in those regions in which said pile threads are not used for connecting the cover layers can either lie so as to float between the cover layers or be connected to one of the cover layers by tuck loops, preferably at a regular spacing. In the case of the second alternative, that cover layer in which the pile thread is tied into is also not thicker or denser than the opposite cover layer.

The cover layers herein can preferably be both produced in a single-threaded manner. However, a production of the cover layers using a plurality of ground threads is of course also possible.

In order for the profiled effect to be visually highlighted in the knitted spacer fabric, said profiled effect being caused by the use of pile threads of dissimilar elasticity, at least one of the cover layers in every region that is knitted using another pile thread can be knitted using a different-colour pile thread. For example, the thicker regions of the knitted spacer fabric can thus be highlighted by way of a lighter colour than the regions of lesser thickness.

The potential applications of a knitted spacer fabric according to the invention are very diverse. The knitted spacer fabric can in particular be used for producing a shoe upper part, a clothing part, a furniture cover, a seat cover, or upholstery elements. Said knitted fabrics can advantageously also be used for technical applications.

A knitted spacer fabric according to the invention and two different thread profiles for the production of the former will be described in more detail hereunder by means of the drawing.

BRIEF DESCRIPTION OF THE DRAWING FIGURES

DETAILED DESCRIPTION OF THE INVENTION

Figure 1:
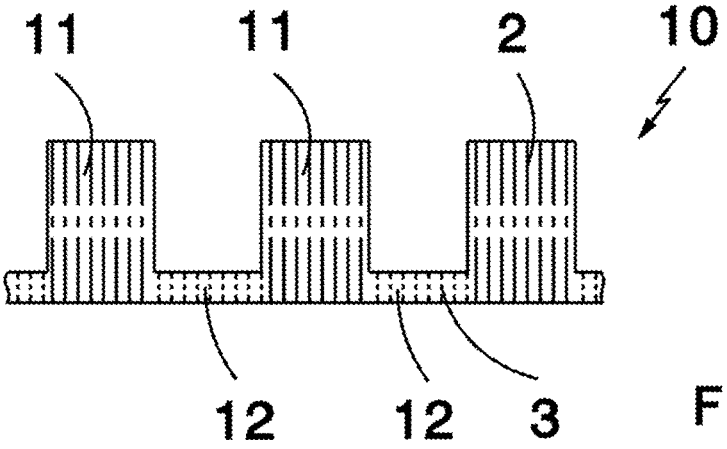
FIG. 1 shows a plan view of a fragment of a knitted spacer fabric.

The knitted spacer fabric 10 illustrated in FIG. 1 is distinguished by a stripe-shaped profiled pattern which is formed by alternating regions 11 and 12 which are in each case knitted using another pile thread. The regions 11 herein are knitted using a pile thread of lower elasticity than the regions 12. The knitted fabric 10 in the regions 11 therefore has a greater thickness than in the regions 12. The striped pattern illustrated is only exemplary. The knitted fabric can have any arbitrary profiled pattern and also be knitted using more than two different pile threads.

Figure 2:
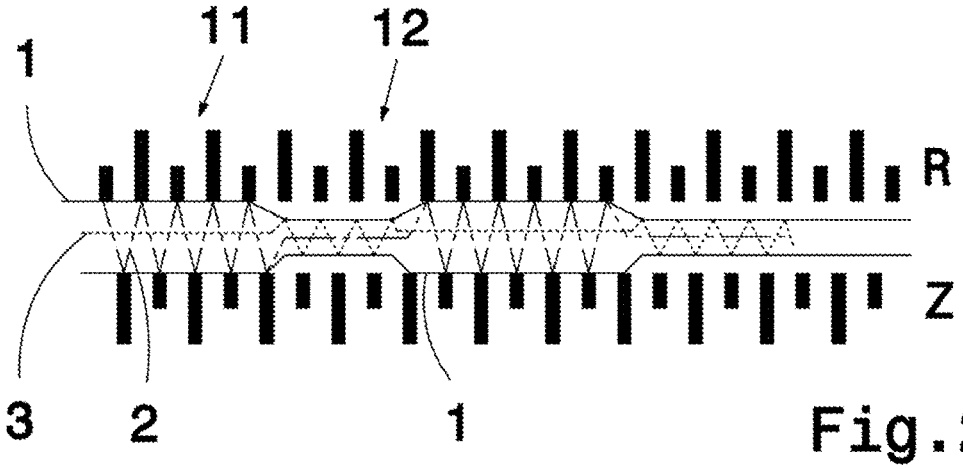
FIG. 2 shows a first thread profile for producing a knitted spacer fabric as per FIG. 1.
Figure 3:
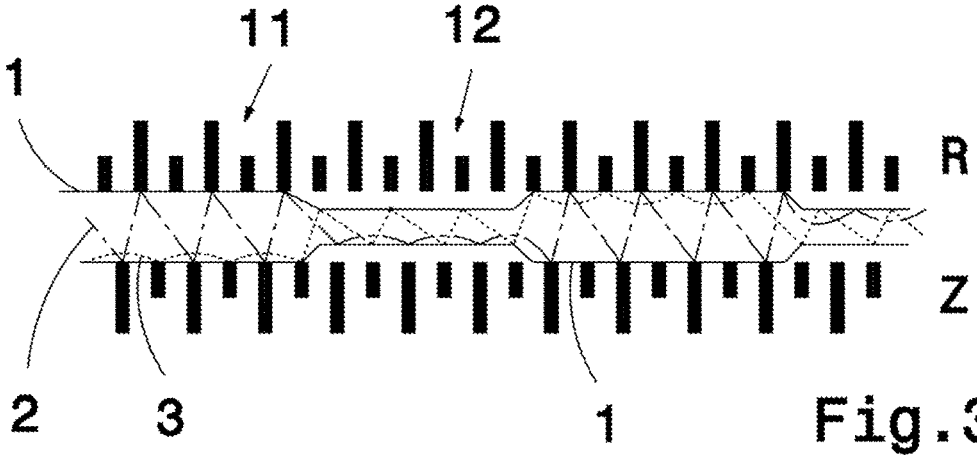
FIG. 3 shows a second thread profile for producing a knitted spacer fabric as per FIG. 1.

FIGS. 2 and 3 show two alternative possibilities for producing the knitted fabric in FIG. 1. The cover layers of the knitted spacer fabric 10 in both figures are knitted using the same ground thread 1. The upper cover layer herein is produced using needles of a rib dial R of a circular knitting machine, and the lower cover layer is produced using needles of a cylinder of the circular knitting machine. The cover layers in the regions 11 are connected to one another using a first pile thread 2 having a low elasticity, and in the regions 12 are connected to one another using a second pile thread 3 having a high elasticity.

In the case of the variant of the production of the knitted fabric 10 shown in FIG. 2, the pile threads 2, 3 are guided so as to float between the loops of the cover layers when the respective other thread is in use. The pile thread 2 thus lies so as to float in the regions 12, and the pile thread 3 lies so as to float in the regions 11.

By contrast, in the variant shown in FIG. 3 the pile threads 2, 3 that are not currently required are bound by tuck loops on each second needle of the cylinder Z. The pile thread 3 is thus bound on the lower cover layer in the regions 11, and the pile thread 2 is thus bound on the lower cover layer in the regions 12. This binding could also be performed at larger spacings. Of course, binding is also possible on the needles of the rib dial.

The knitted fabric 10 could moreover also be produced on a flat knitting machine. An elastane thread could also be used for the more elastic pile thread 3. By contrast, the low-elastic thread 2 can be a monofilament thread from polyester or polyamide. Arbitrary thread materials can be used for the ground threads of the cover layers. Said thread materials can be chosen so as to depend on the desired functionality of the knitted fabric 10.

What is claimed is:

1. A knitted spacer fabric produced on a circular knitting machine, the knitted spacer fabric comprising: a knitted upper cover layer and a knitted lower cover layer, said cover layers being connected to one another by pile threads, wherein the cover layers are connected to one another by way of at least two different pile threads of the pile threads having dissimilar elasticity properties, the pile threads are not conjointly knitted in the cover layers and, wherein a pile thread not used for connecting the cover layers in a region is connected to one of the cover layers by tuck loops on each second needle.

2. The knitted spacer fabric according to claim 1, wherein only one pile threads of the pile threads is used for connecting the cover layers, such that a spacing between the cover layers is smaller in a first region in which a more elastic pile thread of the pile threads is used than in a second region in which a less elastic pile thread of the pile threads is used.

3. The knitted spacer fabric according to claim 1, wherein at least one of the pile threads of the pile threads is a monofilament thread.

4. The knitted spacer fabric according to claim 1, wherein the pile threads are connected to the cover layers by means of tuck loops.

5. The knitted spacer fabric according to claim 2 wherein the pile threads float in the first region and the second region in which said pile threads are not used for connecting the cover layers.

6. The knitted spacer fabric according to claim 2, wherein the pile threads in the first region and the second region in which said pile threads are not used for connecting the cover layers are connected to one of the cover layers by tuck loops.

7. The knitted spacer fabric according to claim 1, wherein the cover layers are produced from one or a plurality of ground threads.

8. The knitted spacer fabric according to claim 1, wherein at least one of the cover layers has a Jacquard pattern.

9. The knitted spacer fabric according to claim 2, wherein at least one of the cover layers in the first region and the second region which is knitted using another pile thread of the pile threads is knitted using a different-colour thread.

10. An article comprising the knitted spacer fabric according to claim 1.

* * * * *